US007163418B2

(12) United States Patent
Macor

(10) Patent No.: US 7,163,418 B2
(45) Date of Patent: Jan. 16, 2007

(54) WALL PLATE COMPRISING SIGNAL SPLITTING DEVICE

(75) Inventor: Richard J. Macor, Hunterdon County, NJ (US)

(73) Assignee: Proprietary Technologies, Inc.

( * ) Notice: Subject to any disclaimer, the term of this patent is extended or adjusted under 35 U.S.C. 154(b) by 107 days.

(21) Appl. No.: 11/026,138

(22) Filed: Dec. 30, 2004

(65) Prior Publication Data

US 2006/0148321 A1 Jul. 6, 2006

(51) Int. Cl.
*H01R 13/66* (2006.01)

(52) U.S. Cl. ..... 439/536; 439/535; 439/49

(58) Field of Classification Search ..... 439/535, 439/49, 536; 381/87, 332, 381; 181/148, 181/150

See application file for complete search history.

(56) References Cited

U.S. PATENT DOCUMENTS 4,477,141 A * 10/1984 Hardesty ..... 439/535
5,599,190 A * 2/1997 Willette ..... 439/49
5,651,696 A * 7/1997 Jennison ..... 439/536
5,882,215 A * 3/1999 Burns ..... 439/142
2003/0099228 A1 * 5/2003 Alcock ..... 370/353

* cited by examiner

*Primary Examiner*—Michael C. Zarroli

(57) ABSTRACT

In one embodiment of the present invention, a wall plate formed to cover a wall box is described. The wall plate comprises a back side which has a signal splitting device with a first coupling member formed and exposed for connectability with an antenna or cable wire device transferring an incoming signal. The signal splitting device is configured to split the incoming signal into at least two outgoing signals. The signal splitting device has a second coupling member formed and exposed at the backside for connectability with an antenna or cable wire device to transfer one of the at least two outgoing signals. And, the wall plate has a front side which has a third coupling member formed and exposed for connectability with an antenna or cable wire device to transfer one of the at least two outgoing signals. The third coupling member connects to and is a part of the signal splitting device.

14 Claims, 2 Drawing Sheets

FIG. 1
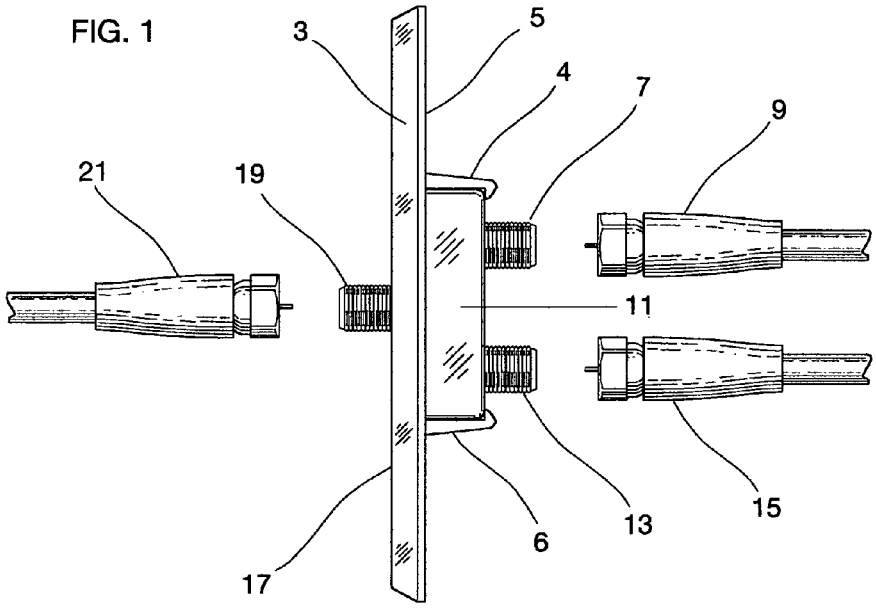
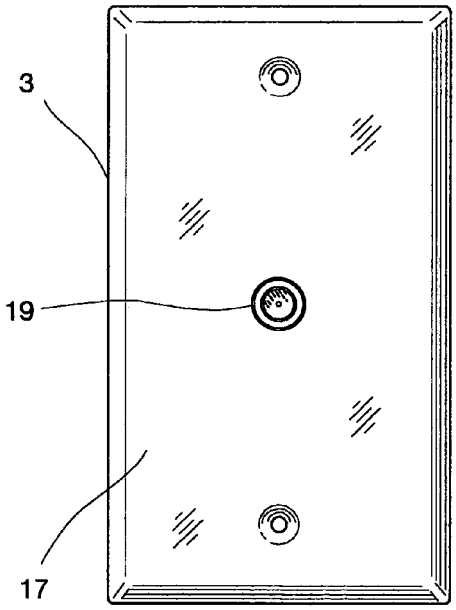
FIG. 2
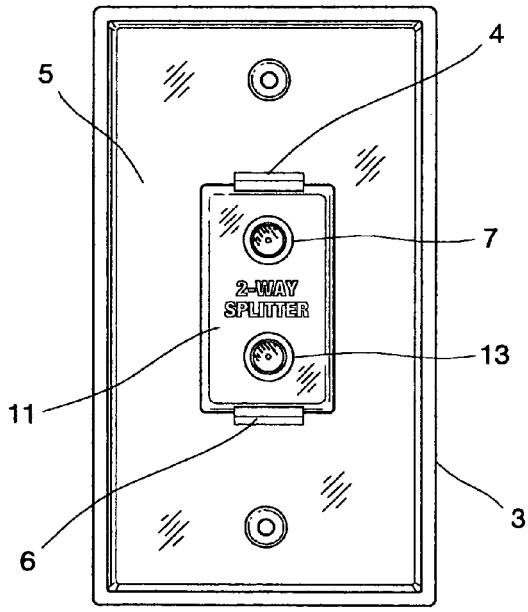
FIG. 3

FIG. 4
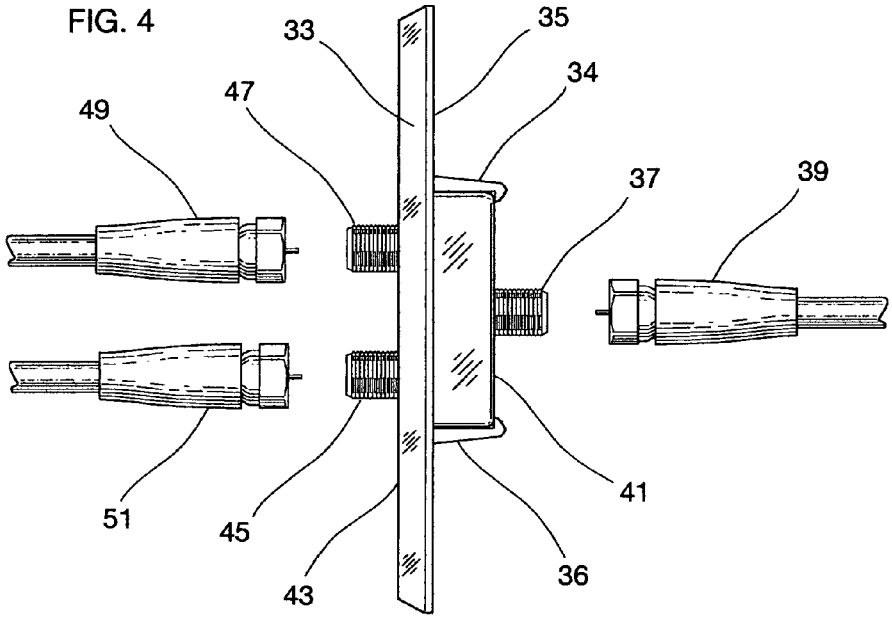
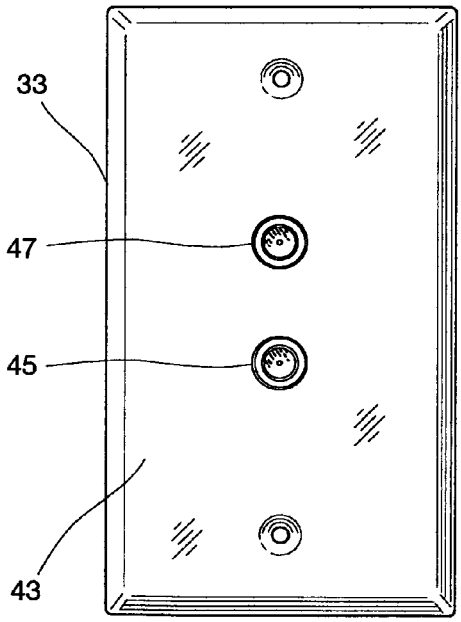
FIG. 5
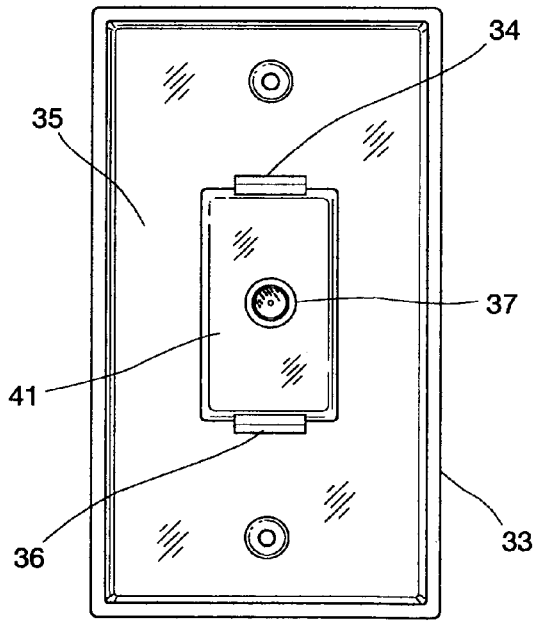
FIG. 6

WALL PLATE COMPRISING SIGNAL SPLITTING DEVICE

FIELD OF THE INVENTION

The present invention relates to a wall plate formed to cover a wall opening or wall box and provide connection means to transfer an antenna or cable wire signal into a room or rooms for a radio, television etc.

BACKGROUND OF THE INVENTION

Transferring a signal from a signal source into a building room for connection with a radio or television, etc. often requires that an antenna or cable wire (such as a coaxial cable) be run from a signal source outside the building into and through the building, then into the room wherein the radio, television, etc. is to be used. A wall plate is commonly used to finish and cover the opening of the wall or wall box where the antenna or cable wire enters into the room. Many wall plates have a "feed thru" connector installed therein to provide for a cable wire connection at the room side and the wall side of the wall plate. When running a cable wire to more than one location in a building, it is common to connect an additional cable wire to an existing cable wire to utilize its signal instead of running many separate wires from the source. This operation requires a signal splitting device or "T" coupling, and additional labor to cut, strip and prepare the cable wires of both the additional and existing cable wires for installation with the signal splitting device. This operation requires additional tools, parts, labor and time. A way to reduce the labor would be to attach a separate "T" coupling to the wall side of a "feed thru" connector mounted in a wall plate. This arrangement would eliminate the labor required to cut and prepare the cable wires, however, would still require the addition of the "T" coupling part and associated installation labor. Unfortunately, most wall boxes and/or wall openings have a limited space and depth which often precludes the use of a separate "T" coupling attached to a "feed thru" connector at the backside of a wall plate. Accordingly, when considering cost, labor, and space-efficiency, there is a need to develop a more efficient way to connect an additional cable wire to an existing cable wire and signal. Therefore, applicant contemplates an improved wall plate that will provide for the connectability of an additional cable wire to an existing cable wire and signal, requiring less parts, less labor, and less space than the aforementioned prior art.

SUMMARY OF THE INVENTION

One embodiment of the present invention involves a wall plate formed to cover a wall box or wall opening. The wall plate comprises a back side which has a signal splitting device with a first coupling member formed and exposed for connectability with an antenna or cable wire device transferring an incoming signal. The signal splitting device is configured to split the incoming signal into at least two outgoing signals. The signal splitting device also has a second coupling member formed and exposed at the backside for connectability with an antenna or cable wire device to transfer one of the at least two outgoing signals. And, the wall plate has a front side which has a third coupling member formed and exposed for connectability with an antenna or cable wire device to transfer one of the at least two outgoing signals. The third coupling member connects to and is a part of the signal splitting device.

When considering cost, labor and space efficiency, applicant considers the following objectives for the present invention.

It is an important objective of the present invention described above that it provide for the connectability of an antenna or cable wire device to transfer a signal into a room or rooms for a radio, television, etc.

It is another important objective of the present invention described above, that it provide for the connectability of an additional cable wire to an existing cable wire and signal, to distribute the signal to another location without the use of additional parts other than the improved wall plate.

It is another important objective of the present invention described above, that it provide for the labor-efficient connectability of an additional cable wire to an existing cable wire and signal, to distribute the signal to another location without the need to cut, strip and prepare the additional and existing cable wires.

It is another important objective of the present invention described above, that it provide for the space-efficient connectability of an additional cable wire to an existing cable wire and signal within the limited space and depth provided by most wall boxes and/or wall openings.

It is another important objective of the present invention described above, that it finish off and cover the wall box and/or wall opening.

And, it is yet another important objective of the present invention described above, that it be cost efficient to manufacture and commercially viable.

BRIEF DESCRIPTION OF THE DRAWINGS

FIG. 1 shows a right side elevation view of an embodiment of the present invention wall plate; and, FIG. 2 shows a front elevation view of the present invention wall plate shown in FIG. 1; and, FIG. 3, shows a back elevation view of the present invention wall plate shown in FIGS. 1 and 2; and, FIG. 4 shows a right side elevation view of another embodiment of the present invention wall plate; and, FIG. 5 shows a front elevation view of the present invention wall plate shown in FIG. 4; and, FIG. 6, shows a back elevation view of the present invention wall plate shown in FIGS. 4 and 5.

DETAILED DESCRIPTION OF THE DRAWINGS

Referring now to the drawings which are for the purpose of illustrating preferred embodiments of the present invention, and not for the purpose of limiting same, FIG. 1 shows a right side elevation view of an embodiment of the present invention. Wall plate 3 shown is formed to cover a wall opening and/or wall box (not shown). A "wall box" shall be defined herein as any type of wall box, wire box, electrical box, outlet box, etc. Wall plate 3 could be made of any appropriate material, but a plastic type material is contemplated and probably most cost-efficient. Wall plate 3 has a back side 5 which comprises a signal splitting device 11 with a first coupling member 7 formed and exposed for connectability with an antenna or cable wire device such as coaxial cable 9 used for transferring an incoming signal. Signal splitting device 11 is configured to split the incoming signal into at least two outgoing signals. Signal splitting device 11 also has a second coupling member 13 formed and exposed at the backside 5 of wall plate 3 for connectability with an antenna or cable wire device such as coaxial cable 15, to transfer or distribute one of the at least two outgoing signals from signal splitter 11 to another room or location. Wall plate 3 also has front side 17 with a third coupling member 19 formed and exposed for connectability with an antenna or cable wire device such as coaxial cable 21, to transfer one of the at least two outgoing signals of signal splitting device 11 into a room for a radio, television, etc. In this embodiment shown here in FIG. 1, third coupling device 19 passes through wall plate 3, connects to and is part of signal splitting device 11. The three coupling members 7, 13 and 19 of signal splitting device 11 could be configured in any way to facilitate connectability with each of their counterpart antennae or cable wire devices. In this FIG. 1, common coaxial type cable wires 9, 15 and 21 are shown and therefore respective coupling members 7, 13 and 19 are each externally threaded and configured for connectability with common coaxial type cable wires.

Although it would be possible to mold a wall plate together with a signal splitting device, it may be cost-efficient to have signal splitting device 11 formed as a totally separate component from wall plate 3, and then physically attach the two components together. In this embodiment of the present invention shown here in FIG. 1, signal splitting device 11 is produced as a separate component from wall plate 3, then is fixedly attached to wall plate 3 using flexible locking tabs 4 and 6 as shown. Again, wall plate 3 could be made of any appropriate material, but a plastic type material is contemplated because wall plate 3 could be easily formed with means (such as flexible locking tabs 4 and 6) to attach the signal splitting device. Alternatively, the signal splitting device could simply be attached to the wall plate with fastening hardware such as a nut or a screw, etc. not shown. Therefore, the signal splitting device could also be formed with means for attachment to the wall plate.

FIG. 2 shows a front elevation view of the present invention wall plate shown in FIG. 1.

FIG. 3, shows a back elevation view of the present invention wall plate shown in FIGS. 1 and 2.

FIG. 4 shows a right side elevation view of another embodiment of the present invention wall plate. Wall plate 33 shown is formed to cover a wall opening and/or wall box (not shown). Again, a "wall box" shall be defined herein as any type of wall box, wire box, electrical box, outlet box, etc. Wall plate 33 could be made of any appropriate material, but a plastic type material is contemplated and probably most cost-efficient. Wall plate 33 has a back side 35 which comprises a signal splitting device 41 with a first coupling member 37 formed and exposed for connectability with an antenna or cable wire device such as coaxial cable 39 used for transferring an incoming signal. Signal splitting device 41 is configured to split the incoming signal into at least two outgoing signals. Wall plate 33 also has front side 43 with a second coupling member 45 and a third coupling member 47 each formed and exposed for connectability with an antenna or cable wire device such as coaxial cable wires 51 and 49 respectively. Cable wires 51 and 49 are each used to transfer one of the at least two outgoing signals to a radio, television, etc. In this embodiment shown here in FIG. 4, each of the second and third coupling members 45 and 47 respectively, passes through wall plate 33 and is part of signal splitting device 41. The three coupling members 37, 45 and 47 of signal splitting device 41 could be configured in any way to facilitate connectability with each of their counterpart antennae or cable wire devices. In this FIG. 4, common coaxial type cable wires 39, 51 and 49 are shown and therefore corresponding coupling members 37, 45 and 47 are each externally threaded and configured for connectability with common coaxial type cable wires. Although it would be possible to mold wall plate 33 together with signal splitting device 41, it may be cost-efficient to have signal splitting device 41 produced as a totally separate component from wall plate 33, and then physically attach the two components together. In the embodiment of the present invention shown here in FIG. 4, signal splitting device 41 is produced as a separate component from wall plate 33 and then signal splitting device 41 is fixedly attached to wall plate 33 using the flexible locking tabs 34 and 36 as shown. Again, wall plate 33 could be made of any appropriate material, but a plastic type material is contemplated especially when wall plate 33 could be formed with means (such as flexible locking tabs 34 and 36) to attach signal splitting device 41. Alternatively, the signal splitting device could be simply attached to the wall plate with fastening hardware such as a nut or a screw, etc. not shown. Therefore, the signal splitting device could also be formed with means for attachment to the wall plate.

FIG. 5 shows a front elevation view of the present invention wall plate shown in FIG. 4.

FIG. 6, shows a back elevation view of the present invention wall plate shown in FIGS. 4 and 5.

When considering cost, labor and space efficiency, the present invention wall plate provides for the following: the connectability of an antenna or cable wire device to transfer a signal into a room or rooms for a radio, television, etc.; and, the connectability of an additional cable wire to an existing cable wire and signal, to distribute the signal to another location without the use of additional parts other than the improved wall plate; and, the labor-efficient connectability of an additional cable wire to an existing cable wire and signal, to distribute the signal to another location without the need to cut, strip and prepare the additional and existing cable wires; and, the space-efficient connectability of an additional cable wire to an existing cable wire and signal within the limited space provided by most wall boxes and/or wall openings; and, the finishing and covering of a wall opening and/or wall box. It should be noted that the present invention could easily provide more than two coupling members transferring outgoing signals.

When considering the present invention, simplicity and obviousness should not be confused or considered the same. Accordingly, the novelty and complexity of the present invention must be measured by the many interrelated objectives set forth herein including cost, production, labor efficiency and product space efficiency.

Upon reading and understanding the specification of the present invention described above, modifications and alterations will become apparent to those skilled in the art. It is intended that all such modifications and alterations be included insofar as they come within the scope of the patent as claimed or the equivalence thereof.

Having thus described the invention, the following is claimed:

1. A wall plate formed to cover a wall box or wall opening, said wall plate comprising:

a back side having a signal splitting device with a first coupling member formed externally threaded and exposed for connectability with a coaxial cable wire device transferring an incoming signal, said signal splitting device configured to split said incoming signal into at least two outgoing signals, said signal splitting device having a second coupling member formed externally threaded and exposed at said backside for connectability with a coaxial cable wire device to transfer one of said at least two outgoing signals; and, a front side, having a third coupling member formed externally threaded and exposed for connectability with a coaxial cable wire device to transfer one of said at least two outgoing signals, said third coupling member connecting to and being part of said signal spitting device.

2. A wall plate of claim 1, wherein the signal splitting device is formed as a separate component from said wall plate, and, said signal splitting device is attached to said wall plate.

3. A wall plate of claim 1, wherein the signal splitting device is attached to said wall plate with fastening hardware.

4. A wall plate of claim 1, wherein said wall plate is formed having means for attaching said signal splitting device thereto.

5. A wall plate of claim 1, wherein said signal splitting device is formed having means for attachment to said wall plate.

6. A wall plat formed to cover a wall box or wall opening, said wall plate comprising:

a back side having a signal splitting device with a first coupling member formed externally threaded and exposed for connectability with an a coaxial cable wire device transferring an incoming signal, said signal splitting device configured to split said incoming signal into at least two outgoing signals; and, a front side, having a second coupling member and a third coupling member each formed externally threaded and exposed for connectability with a coaxial cable wire device to transfer one of said at least two outgoing signals, each of said second and third coupling members connecting to and being part of said signal splitting device.

7. A wall plate of claim 6, wherein the signal splitting device is formed as a separate component from said wall plate, and, said signal splitting device is attached to said wall plate.

8. A wall plate of claim 6, wherein said signal splitting device is attached to said wall plate with fastening hardware.

9. A wall plate of claim 6, wherein said wall plate is formed having means for attaching said signal splitting device thereto.

10. A wall plate of claim 6, wherein said signal splitting device is formed having means for attachment to said wall plate.

11. A wall plate formed to cover a wall box or wall opening, said wall plate comprising a back side having a signal splitting device with a first coupling member formed externally threaded and exposed for connectability with a coaxial cable wire device transferring an incoming signal, said signal splitting device configured to split said incoming signal into at least two outgoing signals, said signal splitting device having a second coupling member formed externally threaded and exposed at said backside for connectability with a coaxial cable wire device to transfer one of said at least two outgoing signals; said wall plate further comprising a front side with a third coupling member formed externally threaded and exposed for connectability with a coaxial cable wire device to transfer one of said at least two outgoing signals, said third coupling member connecting to and being pad of said signal splitting device, and, said signal splitting device being formed as a separate component from said wall plate and being attached to said wall plate.

12. A wall plate of claim 11, wherein said signal splitting device is attached to said wall pinto with fastening hardware.

13. A wall plate of claim 11, wherein said wall plate is formed having means for attachment of said signal splitting device thereto.

14. A wall plate of claim 11, wherein said signal splitting device is formed having means for attachment to said wall plate.

* * * * *